US009899149B2

(12) United States Patent
Lee

(10) Patent No.: US 9,899,149 B2
(45) Date of Patent: Feb. 20, 2018

(54) ELECTRONIC COMPONENT AND METHOD OF MANUFACTURING THE SAME

(71) Applicant: SAMSUNG ELECTRO-MECHANICS CO., LTD., Suwon-Si, Gyeonggi-Do (KR)

(72) Inventor: Seung Kyu Lee, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/930,440

(22) Filed: Nov. 2, 2015

(65) Prior Publication Data

US 2016/0189849 A1 Jun. 30, 2016

(30) Foreign Application Priority Data

Dec. 24, 2014 (KR) ..... 10-2014-0189112

(51) Int. Cl.
*H01F 5/00* (2006.01)
*H01F 27/29* (2006.01)
(Continued)

(52) U.S. Cl.
CPC ..... *H01F 41/10* (2013.01); *H01F 17/0013* (2013.01); *H01F 17/04* (2013.01);
(Continued)

(58) Field of Classification Search
CPC ..... H01F 27/2804; H01F 27/2828; H01F 27/255; H01F 27/292; H01F 41/046; H01F 2017/048; H01F 17/04
(Continued)

(56) References Cited

U.S. PATENT DOCUMENTS 6,114,936 A * 9/2000 Yamamoto ..... H01F 27/2804 336/192
6,124,779 A * 9/2000 Yamamoto ..... H01F 17/0013 29/604
(Continued)

FOREIGN PATENT DOCUMENTS

JP 58079706 * 11/1981
JP 58079706 * 5/1983
(Continued)

OTHER PUBLICATIONS

Korean Office Action issued in Korean Application No. 10-2014-0189112 dated Nov. 5, 2015, with English Translation.

*Primary Examiner* — Elvin G Enad
*Assistant Examiner* — Kazi Hossain
(74) *Attorney, Agent, or Firm* — McDermott Will & Emery LLP

(57) ABSTRACT

An electronic component includes a magnetic body having first and second end surfaces opposing each other and first and second side surfaces connected to the first and second end surfaces, and first and second internal coil patterns disposed in the magnetic body and including coil pattern portions having a spiral shape and lead portions connected to ends of the coil pattern portions and exposed to one surfaces of the magnetic body, respectively. The coil pattern portions are exposed to the first and second side surfaces, and first and second side parts are disposed on the first and second side surfaces. A manufacturing method therefore is presented.

16 Claims, 8 Drawing Sheets

(51) Int. Cl.

| | |
|---|---|
| ***H01F 27/28*** | (2006.01) |
| ***H01F 41/10*** | (2006.01) |
| ***H01F 17/00*** | (2006.01) |
| ***H01F 17/04*** | (2006.01) |
| ***H01F 41/04*** | (2006.01) |

(52) U.S. Cl.
CPC ..... *H01F 27/2828* (2013.01); *H01F 27/292* (2013.01); *H01F 41/046* (2013.01); *H01F 2017/048* (2013.01)

(58) Field of Classification Search
USPC ..... 336/192, 83, 200, 232
See application file for complete search history.

(56) References Cited

U.S. PATENT DOCUMENTS 6,609,009 B1 * 8/2003 Kiyosue ..... H01F 17/0033 174/261
6,946,945 B2 * 9/2005 Sato ..... H01C 1/028 336/200
2007/0159282 A1 * 7/2007 Huang ..... H01F 27/255 336/83
2010/0219924 A1 * 9/2010 Wu ..... H01F 17/045 336/83
2012/0032767 A1 * 2/2012 Iwasaki ..... H01F 17/0013 336/200
2013/0222101 A1 * 8/2013 Ito ..... H01F 17/04 336/83
2014/0218150 A1 8/2014 Cho et al.

FOREIGN PATENT DOCUMENTS

JP 2006-278479 A 10/2006
JP 2006-278909 A 10/2006
KR 10-2012-0103523 A 9/2012
KR 10-2013-0049207 A 5/2013
KR 10-2014-0100378 A 8/2014

* cited by examiner

ELECTRONIC COMPONENT AND METHOD OF MANUFACTURING THE SAME

CROSS-REFERENCE TO RELATED APPLICATION

This application claims benefit of priority to Korean Patent Application No. 10-2014-0189112 filed on Dec. 24, 2014, with the Korean Intellectual Property Office, the disclosure of which is incorporated herein by reference.

BACKGROUND

The present disclosure relates to an electronic component and a method of manufacturing the same.

An inductor, an electronic component, is a representative passive element configuring an electronic circuit, together with a resistor and a capacitor, to remove noise.

The inductor is manufactured by forming internal coil patterns in a magnetic body including a magnetic material and forming external electrodes on outer surfaces of the magnetic body.

SUMMARY

An aspect of the present disclosure provides an electronic component in which exposure of internal coil patterns may be prevented and high inductance may be implemented, and a method of manufacturing the same.

According to an aspect of the present disclosure, an electronic component includes a magnetic body having first and second end surfaces opposing each other and first and second side surfaces connected to the first and second end surfaces, and first and second internal coil patterns disposed in the magnetic body, and including coil pattern portions having a spiral shape and lead portions connected to ends of the coil pattern portions and exposed to one surfaces of the magnetic body, respectively. The coil pattern portions are exposed to the first and second side surfaces. First and second side parts cover at least portions of the first and second side surfaces.

According to another aspect of the present disclosure, a method of manufacturing an electronic component includes forming a laminate by forming a plurality of first and second internal coil patterns including coil pattern portions having a spiral shape and lead portions connected to ends of the coil pattern portions, and stacking magnetic sheets on upper and lower portions of the first and second internal coil patterns, cutting the laminate to form individual electronic components in which the first and second internal coil patterns are embedded in a magnetic body of each individual electronic components, to expose the lead portions to first and second end surfaces of the magnetic body and to expose the coil pattern portions to first and second side surfaces of the magnetic body, and forming first and second side parts on the first and second side surfaces of the magnetic body, respectively.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
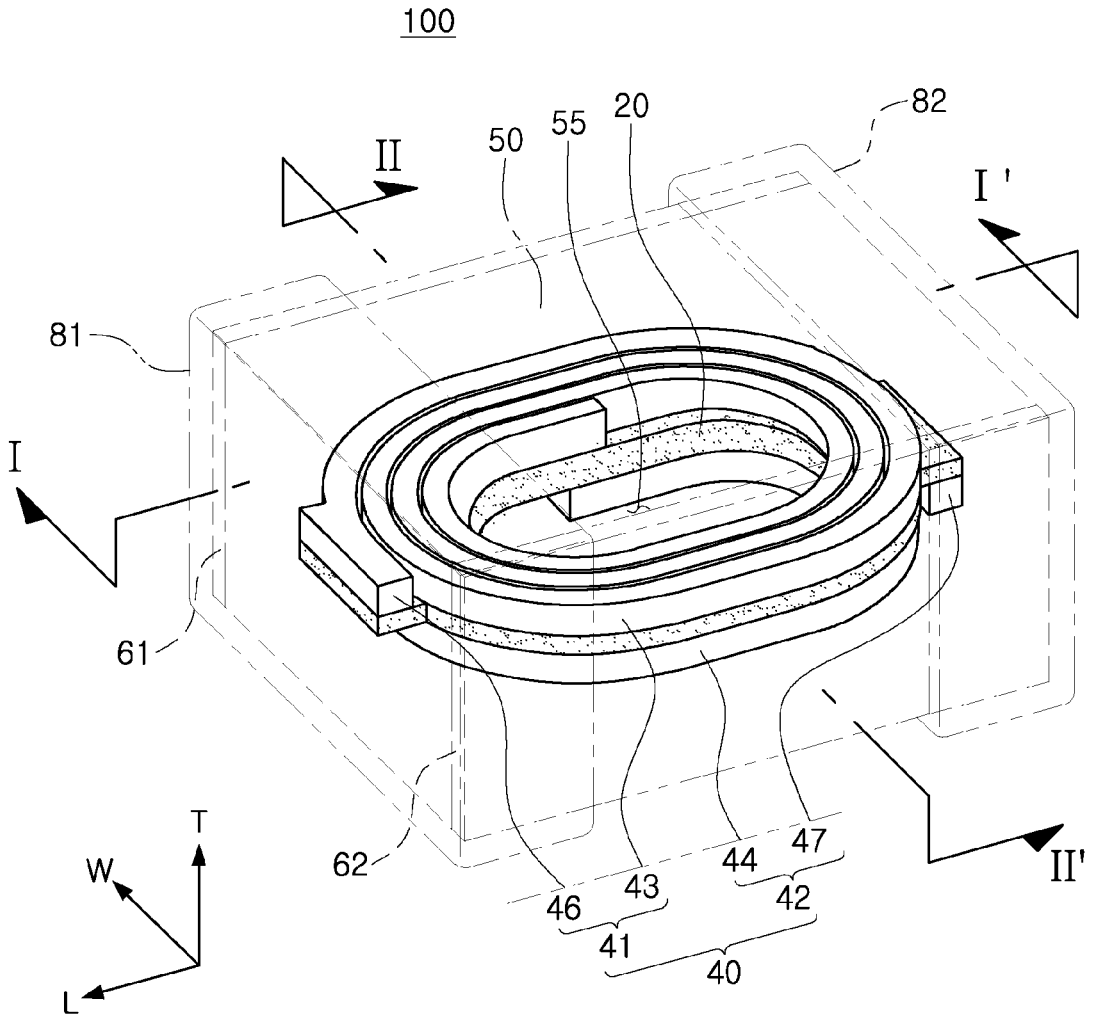
FIG. 1 is a schematic perspective view of an electronic component according to an exemplary embodiment in the present disclosure so that internal coil patterns thereof are visible.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Electronic Component

Hereinafter, an electronic component according to an exemplary embodiment, particularly, a thin film type inductor, will be described. However, the electronic component according to an exemplary embodiment is not necessarily limited thereto.

Figure 2:
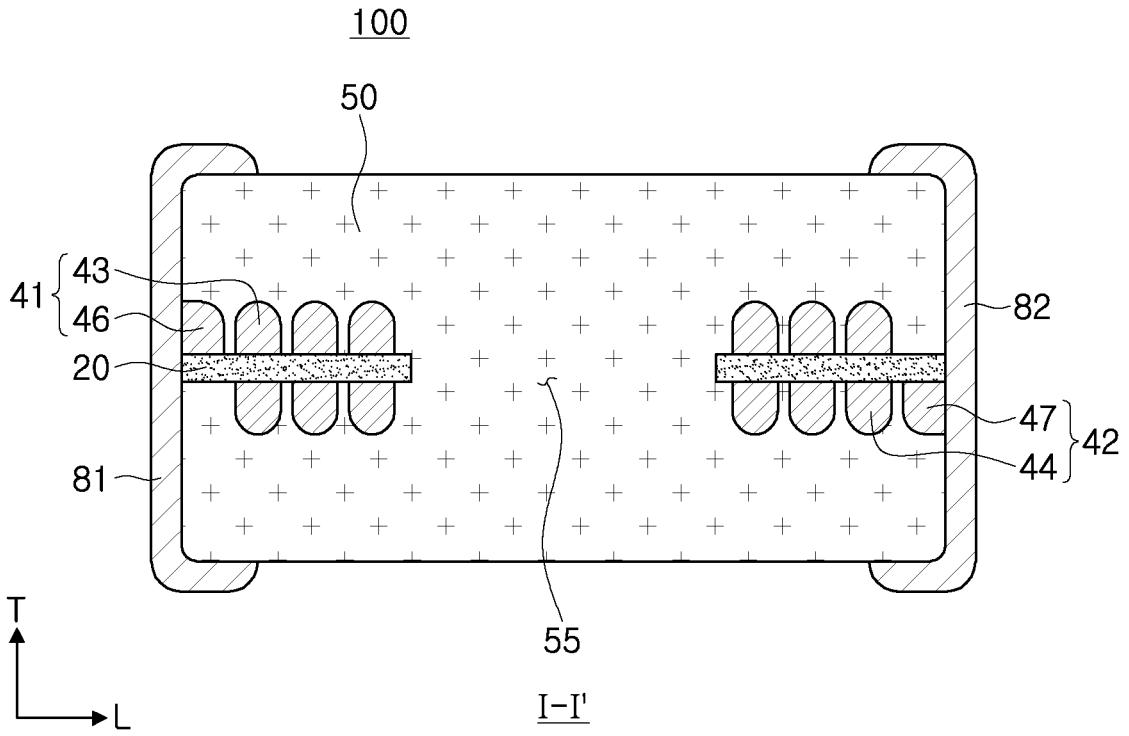
FIG. 2 is a cross-sectional view taken along line I-I' of FIG. 1.

FIG. 1 is a schematic perspective view of an electronic component according to an exemplary embodiment so that internal coil patterns thereof are visible, and FIG. 2 is a cross-sectional view taken along line I-I' of FIG. 1.

Referring to FIG. 1, as an example of the electronic component, a thin film type inductor used in a power line of a power supply circuit is disclosed.

In the electronic component 100 according to an exemplary embodiment, a "length" direction refers to an "L" direction of FIG. 1, a "width" direction refers to a "W" direction of FIG. 1, and a "thickness" direction refers to a "T" direction of FIG. 1.

The electronic component 100, according to an exemplary embodiment, includes a magnetic body 50, internal coil patterns 40 embedded in the magnetic body 50, first and second side parts 61 and 62 disposed at first and second side surfaces of the magnetic body 50, and first and second external electrodes 81 and 82 disposed at outer surfaces of the magnetic body 50 to be connected to the internal coil patterns 40.

The internal coil patterns 40 of the magnetic body 50 of the electronic component 100, according to an exemplary embodiment, include first and second internal coil patterns 41 and 42 therein.

The first internal coil pattern 41 having a plane coil shape are formed on one surface of an insulating substrate 20 disposed in the magnetic body 50, and the second internal coil patterns 42 having a plane coil shape are formed on the other surface of the insulating substrate 20 opposing one surface of the insulating substrate 20.

The first and second internal coil patterns 41 and 42 are formed on the insulating substrate 20 through electroplating, but are not necessarily limited thereto.

The first and second internal coil patterns 41 and 42 may have a spiral shape, and the first and second internal coil patterns 41 and 42 formed on one surface and the other surface of the insulating substrate 20, respectively, may be electrically connected to each other through a via (not illustrated) penetrating through the insulating substrate 20.

The first and second internal coil patterns 41 and 42 and the via may contain a metal having excellent electric conductivity, such as silver (Ag), palladium (Pd), aluminum (Al), nickel (Ni), titanium (Ti), gold (Au), copper (Cu), platinum (Pt), and alloys thereof.

The first and second internal coil patterns 41 and 42 may be coated with an insulating layer (not illustrated), and thus they may not directly contact the magnetic material forming the magnetic body 50.

For example, the insulating substrate 20 may be a polypropylene glycol (PPG) substrate, a ferrite substrate, or a metallic soft magnetic substrate.

The insulating substrate 20 may have a through-hole formed in a central portion thereof to penetrate through the central portion thereof, wherein the through-hole may be filled with a magnetic material to form a core part 55. The core part 55 filled with the magnetic material thus is formed, thereby improving inductance (L).

Meanwhile, the insulating substrate 20 is not necessarily included in the magnetic body, and the internal coil patterns may be formed with a metal wire without including the insulating substrate.

The first and second internal coil patterns 41 and 42 may include coil pattern portions 43 and 44 having a spiral shape, and lead portions 46 and 47 connected to ends of the coil pattern portions 43 and 44 and exposed to one surface of the magnetic body 50.

Referring to FIG. 2, the lead portions 46 and 47 may be formed by extending the one ends of the coil pattern portions 43 and 44, and may be exposed to one surface of the magnetic body 50 to be connected to the first and second external electrodes 81 and 82 disposed in a direction toward the outside of the magnetic body 50.

For example, as shown in FIG. 2, the lead portion 46 of the first internal coil pattern 41 may be exposed to one end surface of the magnetic body 50 in a length L direction, and the lead portion 47 of the second internal coil pattern 42 may be exposed to the other end surface of the magnetic body 47 in the length L direction.

However, the lead portions 46 and 47 of each of the first and second internal coil patterns 41 and 42 are not necessarily limited to being exposed as described above, and may be exposed to at least one surface of the magnetic body 50.

The magnetic body 50 of the electronic component 100, according to an exemplary embodiment, includes magnetic metal powder. However, the magnetic body 50 is not necessarily limited to containing the magnetic metal powder, and may contain any magnetic powder exhibiting magnetic characteristics.

The magnetic metal powder may be a crystalline or amorphous metal containing at least any one selected from the group consisting of iron (Fe), silicon (Si), boron (B), chrome (Cr), aluminum (Al), copper (Cu), niobium (Nb), and nickel (Ni).

For example, the magnetic metal powders may be an Fe—Si—B—Cr based amorphous metal.

The magnetic metal powder may be contained in a thermosetting resin such as an epoxy resin, polyimide, or the like, in a form in which it is dispersed in the thermosetting resin.

Figure 3:
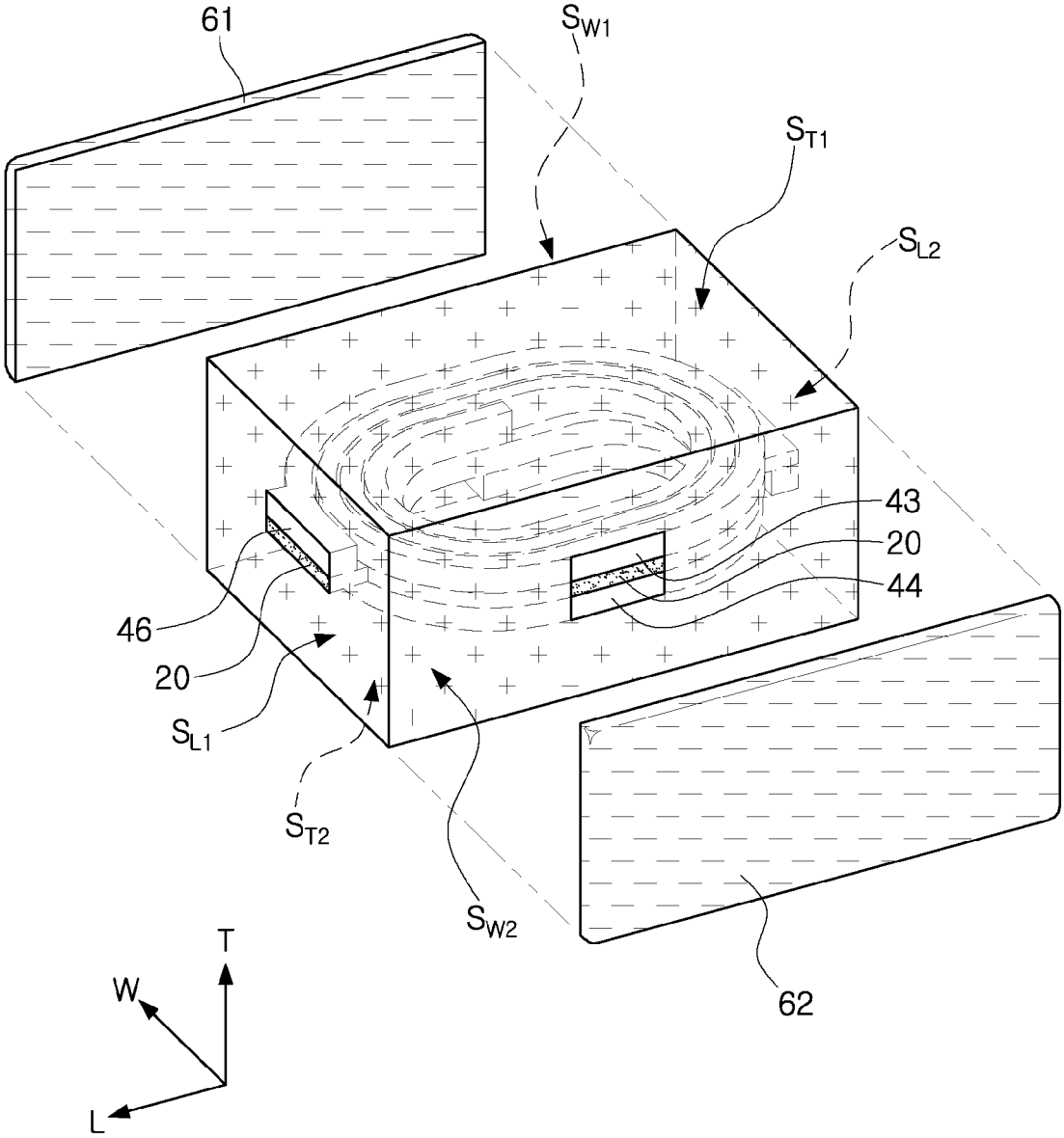
FIG. 3 is an exploded perspective view illustrating a magnetic body and first and second side parts of the electronic component according to the exemplary embodiment in the present disclosure.

FIG. 3 is an exploded perspective view illustrating a magnetic body and first and second side parts of the electronic component according to the exemplary embodiment.

Referring to FIG. 3, the magnetic body 50 of the electronic component 100, according to an exemplary embodiment, has first and second end surfaces $S_{L1}$ and $S_{L2}$ opposing each other in the length L direction, first and second side surfaces $S_{W1}$ and $S_{W2}$ connected to the first and second end surfaces $S_{L1}$ and $S_{L2}$, respectively, and opposing each other in a width W direction, and first and second main surfaces $S_{T1}$ and $S_{T2}$ opposing each other in a thickness T direction.

The coil pattern portions 43 and 44 of the first and second internal coil patterns 41 and 42, according to an exemplary embodiment, are exposed to the first and second side surfaces $S_{W1}$ and $S_{W2}$ of the magnetic body 50.

The first and second side surfaces $S_{W1}$ and $S_{W2}$ to which the coil pattern portions 43 and 44 are exposed may be disposed with the first and second side parts 61 and 62.

In another exemplary embodiment of an electronic component in which side parts are not attached to side surfaces of a magnetic body, the magnetic body includes margin parts having a predetermined interval in a direction toward side surfaces of the magnetic body in order to prevent exposure of the internal coil patterns to the side surfaces of the magnetic body.

However, due to a cutting deviation occurring at the time of cutting the laminate to form the magnetic body, the margin parts may not be appropriately formed, and an electrode exposure defect in which the internal coil patterns are exposed to the side surfaces of the magnetic body may occur.

In addition, a delamination defect rate may be increased due to an increase in electrode steps according to high current of the electronic component.

Accordingly, in an exemplary embodiment, the first and second side parts 61 and 62 may be disposed on the first and second side surfaces $S_{W1}$ and $S_{W2}$ of the magnetic body 50. Therefore, electrode exposure defects may be prevented and delamination defects rate may be reduced.

In addition, in order to further attach the first and second side parts 61 and 62 on the first and second side surfaces $S_{W1}$ and $S_{W2}$ of the magnetic body 50, the margin parts may not be needed in the magnetic body 50, and therefore, the area of the internal coil 40 to be disposed may be significantly increased. As a result, high inductance is implemented.

The first and second side parts 61 and 62 are fixed onto the first and second side surfaces $S_{W1}$ and $S_{W2}$ of the magnetic body 50 to which the coil pattern portions 43 and 44 are exposed.

Boundaries among the magnetic body 50 and the first and second side parts 61 and 62 may be confirmed by using a scanning electron microscope (SEM). However, the magnetic body 50 and the first and second side parts 61 and 62 may not be necessarily classified by the boundaries observed by the SEM, and regions separately attached to the first and second side surfaces $S_{W1}$ and $S_{W2}$ of the magnetic body 50 may be classified as the first and second side parts 61 and 62.

The first and second side parts 61 and 62 may include a thermosetting resin.

For example, the first and second side parts 61 and 62 may include a thermosetting resin such as an epoxy resin, a polyimide resin, or the like. However, the side parts are not necessarily limited to the above-described materials, and may be formed of any material exhibiting an insulation effect.

The first and second side parts 61 and 62 in the embodiment are formed by applying the thermosetting resin to the first and second side surfaces $S_{W1}$ and $S_{W2}$ of the magnetic body 50 to which the coil pattern portions 43 and 44 are exposed, and performing a hardening process, but the method of forming the side parts is not necessarily limited thereto.

The first and second side parts 61 and 62 may further include magnetic metal powder to implement higher inductance.

The first and second side parts 61 and 62 may include the magnetic metal powder having an amount of 3 wt % to 70 wt %.

When the first and second side parts 61 and 62 include less than 3 wt % of the magnetic metal powder, increased inductance may not be significant, and when the first and second side parts 61 and 62 include more than 70 wt % of the magnetic metal powder, increased rate of inductance may be small, and appearance defects may occur.

The first and second side parts 61 and 62 may be formed on the entire area of the first and second side surfaces $S_{W1}$ and $S_{W2}$ of the magnetic body 50.

In order to effectively insulate the coil pattern portions 43 and 44 exposed to the first and second side surfaces $S_{W1}$ and $S_{W2}$, the first and second side parts 61 and 62 may be formed on the entire area of the first and second side surfaces $S_{W1}$ and $S_{W2}$. Meanwhile, the first and second side parts 61 and are not necessarily limited to being formed by the above-described methods, and may be formed only on a portion of the first and second side surfaces $S_{W1}$ and $S_{W2}$.

Figure 4:
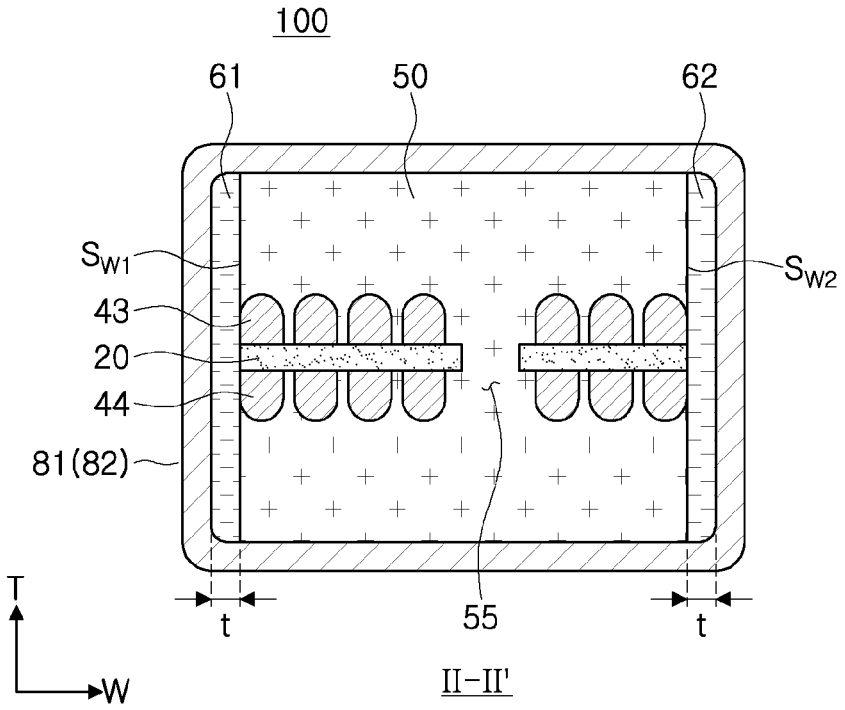
FIG. 4 is a cross-sectional view taken along line II-II' of FIG. 1.

FIG. 4 is a cross-sectional view taken along line II-II' of FIG. 1.

Referring to FIG. 4, the coil pattern portions 43 and 44 of the first and second internal coil patterns 41 and 42 may be exposed to the first and second side surfaces $S_{W1}$ and $S_{W2}$ of the magnetic body 50, and the first and second side parts 61 and 62 may be disposed on the first and second side surfaces $S_{W1}$ and $S_{W2}$.

High inductance may be implemented since the internal coil 40 has a significantly increased area so that the coil pattern portions 43 and 44 are exposed to the first and second side surfaces $S_{W1}$ and $S_{W2}$ of the magnetic body 50.

Each of the first and second side parts 61 and 62 may have a thickness t of 10 μm to 40 μm.

When the thickness t of the first and second side parts 61 and 62 is less than 10 μm, the coil pattern parts 43 and 44 exposed to the first and second side surfaces $S_{W1}$ and $S_{W2}$ may not be insulated, and when the thickness t of the first and second side parts 61 and 62 is more than 40 μm, a volume occupied by the first and second side parts 61 and 62 may be excessively increased, and therefore, it may be difficult to implement high inductance.

Figure 5:
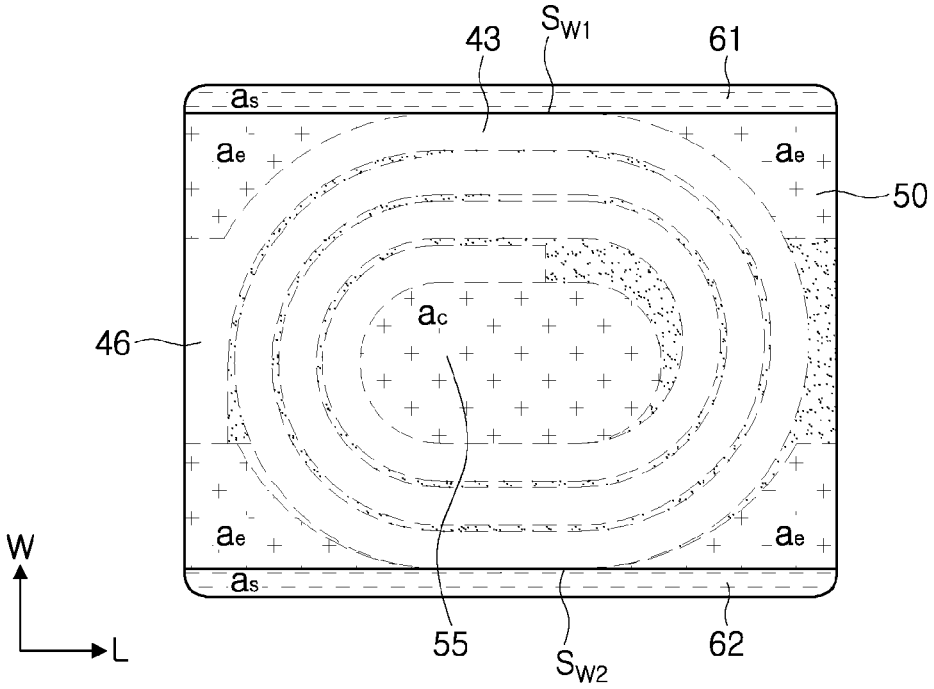
FIG. 5 is a top plan view of a magnetic body and first and second side parts of the electronic component according to an exemplary embodiment in the present disclosure.

FIG. 5 is a top plan view of the magnetic body and first and second side parts of the electronic component according to an exemplary embodiment.

Referring to FIG. 5, in the electronic component according to an exemplary embodiment, with an area of a cross section of a core part 55 formed at an inner side of the first and second internal coil patterns 41 and 42 in a length-width L-W direction being $a_c$, the sum of areas of cross sections of the magnetic body 50 at an outer side of the first and second internal coil patterns 41 and 42 in the length-width L-W direction being $a_e$, and the sum of areas of cross sections of the first and second side parts 61 and 62 in the length-width L-W direction being $a_s$, $a_e+a_s \leq a_c$ may be satisfied.

Since the first and second side parts 61 and 62 are further attached on the first and second side surfaces $S_{W1}$ and $S_{W2}$ of the magnetic body 50, the margin parts may not be needed in the magnetic body 50, and therefore, the first and second internal coil patterns 41 and 42 may have a significantly increased area so that the coil pattern portions 43 and 44 are exposed to the first and second side surfaces $S_{W1}$ and $S_{W2}$ of the magnetic body 50.

Accordingly, the area $a_c$ of the core part 55 formed in the first and second internal coil patterns 41 and 42 may be increased, and $a_e+a_s \leq a_c$ may be satisfied.

The electronic component according to an exemplary embodiment may satisfy $a_e+a_s \leq a_c$ to implement high inductance.

Method of Manufacturing an Electronic Component

FIGS. 6A, 6B, 7, and 8 are views schematically illustrating a method of manufacturing an electronic component according to the exemplary embodiment.

Figure 6A:
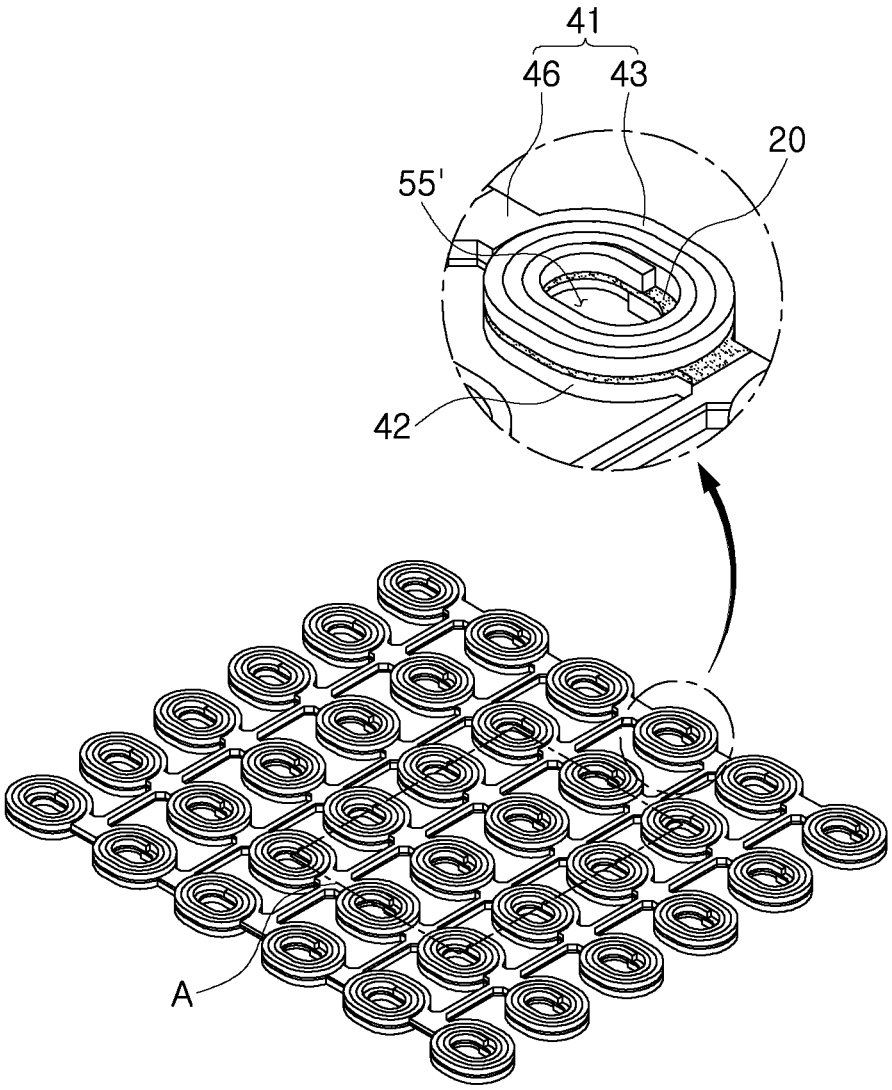
FIGS. 6A, 6B, 7, and 8 are views schematically illustrating a method of manufacturing an electronic component according to the exemplary embodiment in the present disclosure.

Referring to FIG. 6A, a plurality of first and second internal coil patterns 41 and 42 may be formed on one surface and the other surface of an insulating substrate 20.

A via hole (not illustrated) may be formed in the insulating substrate 20, a plating resist having an opening part may be formed on the insulating substrate 20, and the via hole and the opening part may be filled with a conductive metal by plating to form the first and second internal coil patterns 41 and 42 and a via (not illustrated) connecting the first and second internal coil patterns.

The first and second internal coil patterns 41 and 42 and the via may be formed of a conductive metal having excellent electrical conductivity, such as silver (Ag), palladium (Pd), aluminum (Al), nickel (Ni), titanium (Ti), gold (Au), copper (Cu), platinum (Pt), and alloys thereof.

Meanwhile, the formation of the internal coil patterns 41 and 42 is not necessarily limited to the above-described plating, and the internal coil patterns may be formed of a metal wire.

The first and second internal coil patterns 41 and 42 may include coil pattern portions 43 and 44 having a spiral shape, and lead portions 46 and 47 connected to ends of the coil pattern parts 43 and 44.

Insulating layers (not illustrated) coating the first and second internal coil patterns 41 and 42 may be formed on the first and second internal coil patterns 41 and 42.

The insulating layer (not illustrated) may be formed by a method well-known in the art such as a screen printing method, an exposure and development method of a photoresist (PR), a spray applying method, or the like.

For example, the insulating substrate 20 may be a polypropylene glycol (PPG) substrate, a ferrite substrate, a metallic soft magnetic substrate, and the like.

The insulating substrate 20 may have a core part hole 55' formed by removing a central portion of a region in which the first and second internal coil patterns 41 and 42 are not formed.

The insulating substrate 20 may be removed by mechanical drilling, laser drilling, sandblasting, punching, or the like.

Figure 6B:
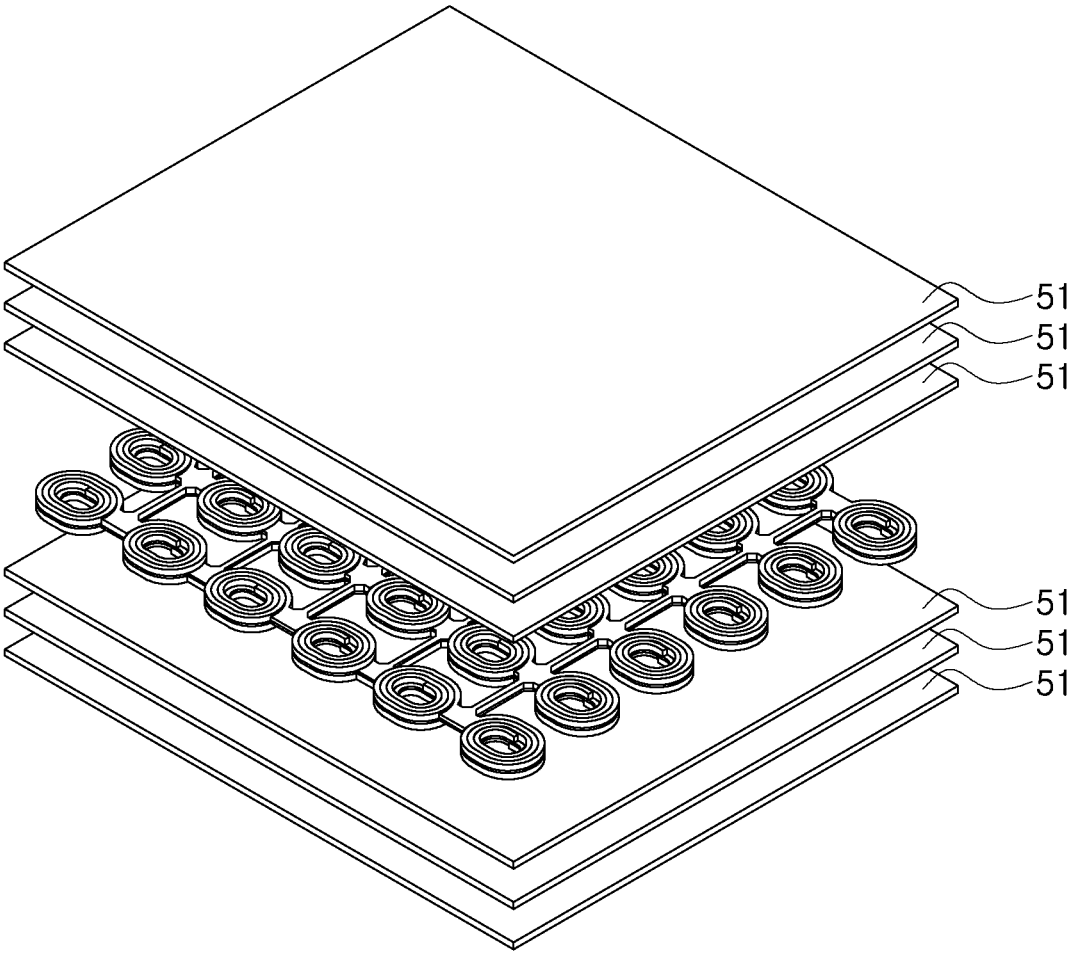

Referring to FIG. 6B, magnetic sheets 51 may be stacked on upper and lower portions of the first and second internal coil patterns 41 and 42 to form a laminate.

The magnetic sheets 51 may be manufactured in a sheet shape by mixing magnetic metal powder, a thermosetting resin, and organic materials such as a binder, a solvent, and the like, with each other to prepare slurry and applying and then drying the slurry at a thickness of several tens of micrometers on carrier films by a doctor blade method.

In the manufactured magnetic sheets 51, the magnetic metal powder may be dispersed in the thermosetting resin such as an epoxy resin, polyimide, or the like.

The magnetic sheets 51 may be stacked, compressed and hardened to form the laminate in which the internal coil patterns 41 and 42 are embedded.

The core part hole 55' may be formed with magnetic material to form a core part 55.

FIG. 6B illustrates stacking the magnetic sheets 51 to form the laminate 50 in which the internal coil patterns 41 and 42 are embedded. However, the laminate 50 is not necessarily limited to being formed by the above-described method, and may be formed by any method that may form a magnetic metal powder-resin composite in which the internal coil patterns are embedded.

Figure 7:
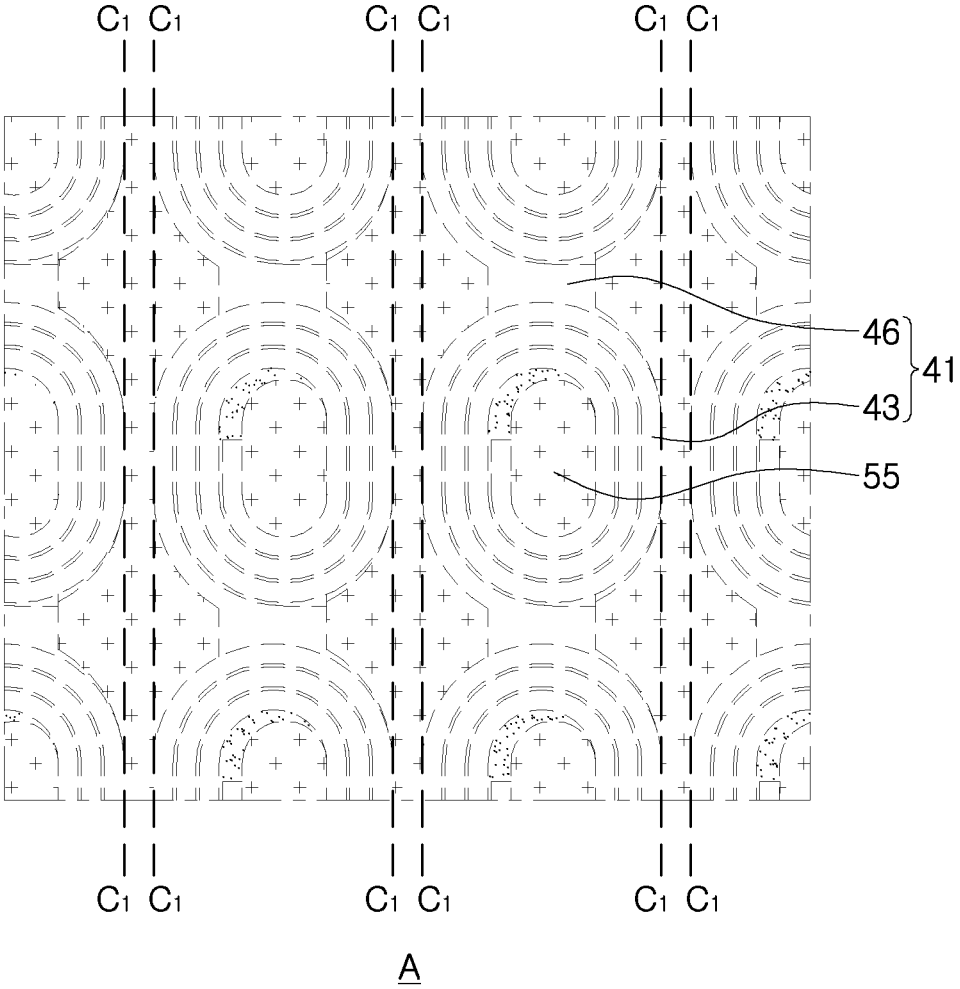

Referring to FIG. 7, the laminate may be cut along a $C_1$-$C_1$ cutting line to expose the coil pattern parts 43 and 44.

Figure 8:
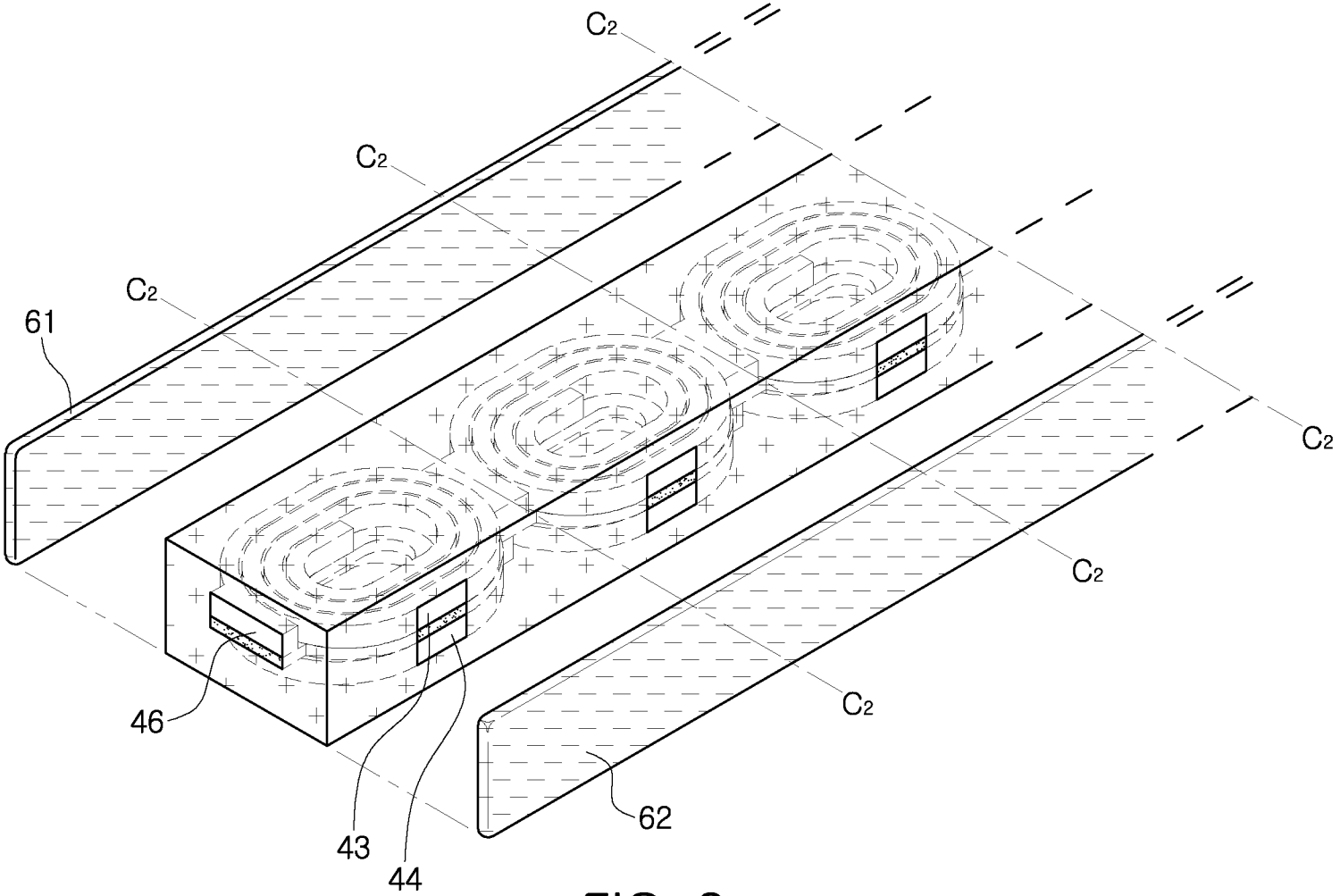

Referring to FIG. 8, the first and second side parts 61 and 62 may be formed on surfaces to which the coil pattern parts 43 and 44 are exposed, and the laminate may be cut along a $C_2$-$C_2$ cutting line to form individual electronic components in which the first and second internal coil patterns 41 and 42 are embedded in the magnetic body 50.

A sequence of the formation of the first and second side parts 61 and 62 and the formation of the individual electronic components by cutting the laminate is not necessarily limited to the above-described sequence.

As illustrated in FIG. 8, the first and second side parts 61 and 62 may be formed and the laminate may be cut into the individual electronic components, or the laminate may be cut into the individual electronic components and the first and second side parts 61 and 62 may be formed.

In the cutting of the laminate, the lead portions 46 and 47 may be exposed to first and second end surfaces $S_{L1}$ and $S_{L2}$ of the magnetic body 50, and the coil pattern parts 43 and 44 may be exposed to first and second side surfaces $S_{W1}$ and $S_{W2}$ of the magnetic body 50.

According to a method of manufacturing an electronic component according to an exemplary embodiment, since the first and second side parts 61 and 62 are formed on the first and second side surfaces $S_{W1}$ and $S_{W2}$ of the magnetic body 50, the margin parts may not be needed in the magnetic body 50, and therefore, the first and second internal coil patterns 41 and 42 may have significantly increased areas. As a result, high inductance may be implemented.

The first and second side parts 61 and 62 may be formed by applying and hardening a thermosetting resin such as an epoxy resin, polyimide, or the like, on a surface to which the coil pattern parts 43 and 44 are exposed, but the first and second side parts 61 and 62 are not necessarily limited to being formed by the above-described methods.

The first and second side parts 61 and 62 may further include magnetic metal powder. The first and second side parts 61 and 62 may further include magnetic metal powder to implement higher inductance.

The first and second side parts 61 and 62 may include 3 wt % to 70 wt % of the magnetic metal powder.

When the first and second side parts 61 and 62 include less than 3 wt % of the magnetic metal powder, an increased inductance may not be significant, and when the first and second side parts 61 and 62 include more than 70 wt % of the magnetic metal powder, an increased rate of inductance may be small, and appearance defects may occur.

The first and second side parts 61 and 62 may have a thickness t of 10 μm to 40 μm.

When the thickness t of the first and second side parts 61 and 62 is less than 10 μm, the coil pattern parts 43 and 44 exposed to the first and second side surfaces $S_{W1}$ and $S_{W2}$ may not be insulated, and when the thickness t of the first and second side parts 61 and 62 is more than 40 μm, a volume occupied by the first and second side parts 61 and 62 may be excessively increased, and therefore, it may be difficult to implement high inductance.

A description of features overlapping with those of the electronic component according to the exemplary embodiment described above except for the above-mentioned description will be omitted.

As set forth above, according to exemplary embodiments, exposure of the internal coil patterns may be prevented and high inductance may be implemented.

While exemplary embodiments have been shown and described above, it will be apparent to those skilled in the art that modifications and variations could be made without departing from the scope of the present disclosure as defined by the appended claims.

What is claimed is:

1. An electronic component comprising:

a magnetic body having first and second end surfaces opposing each other and first and second side surfaces connected to the first and second end surfaces; and first and second internal coil patterns disposed in the magnetic body, each including a coil pattern portion having a spiral shape that includes a plurality of windings, and including lead portions connected to ends of the coil pattern portions and exposed to at least one end surface of the magnetic body, wherein only one winding of each of the coil pattern portions is exposed to at least one of the first and second side surfaces; and first and second side parts covering at least portions of the magnetic body on the first and second side surfaces and portions of the coil pattern portions exposed through the magnetic body to the first and second side surfaces.

2. The electronic component of claim 1, wherein the first and second side parts include a thermosetting resin.

3. The electronic component of claim 2, wherein the first and second side parts further include a magnetic metal powder.

4. The electronic component of claim 3, wherein the first and second side parts include 3 wt % to 70 wt % of the magnetic metal powder.

5. The electronic component of claim 1, wherein the first and second side parts are fixed onto the first and second side surfaces.

6. The electronic component of claim 1, wherein the first and second internal coil patterns are formed by plating.

7. The electronic component of claim 1, wherein the first and second internal coil patterns are formed of a metal wire.

8. The electronic component of claim 1, further comprising:

first and second external electrodes disposed on the first and second end surfaces and connected to the lead portions, wherein the lead portions are exposed to the first and second end surfaces.

9. The electronic component of claim 1, wherein the magnetic body includes a thermosetting resin and a magnetic metal power.

10. The electronic component of claim 1, wherein $a_e+a_s \leq a_c$ is satisfied, in which $a_c$ is an area of a cross section of a core part formed at an inner side of the first and second internal coil patterns in a length-width direction, $a_c$ is a sum of areas of cross sections of the magnetic body at an outer side of the first and second internal coil patterns in the length-width direction, and $a_s$ is a sum of areas of cross sections of the first and second side parts in the length-width direction.

11. The electronic component of claim 1, wherein each of the first and second side parts has a thickness of 10 μm to 40 μm.

12. The electronic component of claim 1, wherein the first and second side parts are formed on the entire areas of the first and second side surfaces, respectively.

13. The electronic component of claim 1, wherein the spiral shapes of the first and second internal coil patterns are planar spiral shapes, and the coil pattern portions are exposed to the first and second side surfaces in the plane of the respective planar spiral shape.

14. The electronic component of claim 1, wherein the spiral shapes of the first and second internal coil patterns are planar spiral shapes in parallel planes, and the first and second side parts cover at least portions of the first and second side surfaces orthogonal to the parallel planes of the planar spiral shapes.

15. The electronic component of claim 1, further comprising:

a substrate, wherein the first and second internal coil patterns are disposed on opposing surfaces of the substrate, and the first and second side parts cover at least portions of the first and second side surfaces that are orthogonal to the substrate.

16. The electronic component of claim 1, further comprising:

a substrate, wherein the first and second internal coil patterns each include a plurality of windings and are disposed on opposing surfaces of the substrate, and the substrate is exposed to the first and second side surfaces on which the coil pattern portions of the first and second internal coil patterns are exposed.

* * * * *